US005895208A

United States Patent [19]

Riedlinger et al.

[11] Patent Number: 5,895,208

[45] Date of Patent: Apr. 20, 1999

[54] RECIPROCATING PISTON MACHINE WITH CAPILLARY PASSAGES ON VALVES FOR PRESSURE RELIEF

[75] Inventors: Heinz Riedlinger, Bremen; Erich Becker, Bad Krozingen, both of Germany

[73] Assignee: KNF Neuberger GmbH, Freiburg, Germany

[21] Appl. No.: 08/928,822

[22] Filed: Sep. 12, 1997

[30] Foreign Application Priority Data

Sep. 26, 1996 [DE] Germany ..... 196 39 555

[51] Int. Cl.[6] ..... F04B 39/10

[52] U.S. Cl. ..... 417/571; 417/569; 417/557; 137/513.5

[58] Field of Search ..... 417/569, 571, 417/557; 137/513.5

[56] References Cited

U.S. PATENT DOCUMENTS

| | | | |
|---|---|---|---|
| 2,019,747 | 11/1935 | Taylor | 230/231 |
| 2,151,746 | 3/1939 | Cody | 230/228 |
| 2,981,197 | 4/1961 | Dolza | 103/38 |
| 4,743,169 | 5/1988 | Funakawa et al. | 417/306 |
| 5,327,932 | 7/1994 | Rozek | 137/512.15 |
| 5,567,124 | 10/1996 | Takenaka et al. | 417/222.2 |
| 5,595,214 | 1/1997 | Shaffer et al. | 137/517 |

FOREIGN PATENT DOCUMENTS

| | | |
|---|---|---|
| 31 12 386 A1 | 12/1982 | Germany . |
| 35 14 119 A1 | 10/1986 | Germany . |
| 39 02 658 A1 | 8/1990 | Germany . |
| 41 18 652 A1 | 8/1992 | Germany . |
| 43 43 447 A1 | 6/1994 | Germany . |
| 44 01 836 A1 | 7/1994 | Germany . |
| 5-340355 | 12/1993 | Japan . |
| 63-108577 | 7/1998 | Japan . |
| 764379 | 12/1956 | United Kingdom . |
| 1003011 | 9/1965 | United Kingdom . |
| 1 362 303 | 8/1974 | United Kingdom . |

OTHER PUBLICATIONS

Eckert, E.R.G. and Drake, R.M. Jr., "Heat and Mass Transfer" McGraw–Hill, p. 153, 1959.

*Primary Examiner*—Charles G. Freay
*Assistant Examiner*—Ehud Gartenberg
*Attorney, Agent, or Firm*—Panitch Schwarze Jacobs & Nadel, P.C.

[57] ABSTRACT

A reciprocating piston machine (1) has an inlet valve (9) on the suction side and an outlet valve (10) on the delivery side, which valves exhibit a valve body having a valve disc (11, 12) comprising of an elastomer, whereby the compression chamber (6) sealed off by the reciprocating piston or similar displacer (2) and by the valves (9, 10) has a pressure relief connection between compression chamber and atmosphere. To be able to bring the compression chamber (6) quickly to atmospheric pressure after the reciprocating piston machine (1) has been put out of operation and to be able to bring about the restart of the reciprocating piston machine (1) so as to be load-free in this respect, the valve disc (11,12) of the valve (9, 10) on the delivery side and/or on the suction side has at least one capillary passage (18, 19) as pressure relief connection.

14 Claims, 2 Drawing Sheets

RECIPROCATING PISTON MACHINE WITH CAPILLARY PASSAGES ON VALVES FOR PRESSURE RELIEF

BACKGROUND OF THE INVENTION

The invention relates to a reciprocating piston machine with an inlet valve on the suction side and an outlet valve on the delivery side, which valves exhibit a valve body having an elastic valve disc or valve tongue, whereby the compression chamber sealed off by the reciprocating piston or similar displacer and by the valves has a pressure relief connection between compression chamber and atmosphere.

If a reciprocating piston machine under pressure or vacuum is stopped, the entire load of the gas bears on the piston and the diaphragm. When restarting, the piston force resulting from the gas load and the piston area has to be overcome by the motor starting torque. This requires far more powerful motors than would be necessary for pure full load operation.

To keep the size of the reciprocating piston machines as small and the costs incurred by the motor as low as possible, possibilities are sought to allow escape of the pressure or vacuum left in the compression chamber when the reciprocating piston machine is stopped, for instance through a solenoid valve.

To be able to save the costs of a solenoid valve and the necessary electrical circuitry, it is already known that at that valve of the reciprocating piston machine which seals against the atmosphere, a ridge be formed in the valve seat. Such a defined leakage reduces the volumetric efficiency of the known reciprocating piston machine a little. While such a defined leakage is of no consequence in the case of compressors, in the case of vacuum pumps, however, even the slightest reflux at the valve sealing against the atmosphere can significantly reduce the final pressure of this reciprocating piston machine.

BRIEF SUMMARY OF THE INVENTION

The object underlying the invention is therefore to provide a reciprocating piston machine of the type mentioned at the outset, whose compression chamber can be pressure-relieved in a short time after the reciprocating piston machine has been stopped, without the volumetric efficiency during operation being appreciably reduced as a result. At the same time, these advantages should be attainable without any significant extra expenditure.

This object is accomplished according to the invention in the reciprocating piston machine of the type mentioned at the outset particularly in that the valve disc or valve tongue of the valve on the delivery side and/or on the suction side has at least one capillary passage as pressure relief connection.

In the reciprocating piston machine according to the invention, a capillary passage is provided in the valve disc of the inlet valve and/or outlet valve, capillary passage here being understood to be a connecting passage having a clear sectional area which, by comparison, is very small. The cross section of the passage is dependent, inter alia, on the thickness of the valve disc and on the rotational speed of the reciprocating piston machine. Therefore, in case of a large thickness of the valve disc or valve tongue and/or high rotational speeds of the reciprocating piston machine, a comparatively larger cross section of the passage can be selected.

When the valve is closed, this capillary passage leads from the compression chamber to the outer surface of the valve disc facing away from the compression chamber. During operation of the reciprocating piston machine according to the invention, this capillary passage has no influence and no function. This is so since a reflux from the atmosphere into the compression chamber (vacuum pump) or from the compression chamber into the atmosphere (compressor) can develop via the capillary passage at most in the short time in which the to-and-fro moving valve disc bears against the valve seat.

With the speeds of several 1000 rpm usual, e.g. for piston pumps or diaphragm pumps, however, the valve disc bears only for a fraction of a second against the valve seat. In this short time the reflux is at most minimal because, to form the reflux, the gas first has to develop a certain velocity of flow. During operation, the capillary passage hence has practically no effects on the volumetric efficiency and on the final pressure achievable.

After the reciprocating piston machine has been put out of operation, however, the valve concerned is closed, so that sufficient time is available to develop a gas flow through the capillary passage. Therefore, within a short time, a pressure compensation to atmospheric pressure takes place in the compression chamber, so that subsequent restart of the reciprocating piston machine can take place load-free in this respect.

In the case of universal machines, usable both as a compressor and as a vacuum pump, it may be suitable if such a pressure-relief connection is provided not only at the inlet valve on the suction side, but also at the outlet valve on the delivery side. However, in the case of such reciprocating piston machines as are used either only as a compressor or only as a vacuum pump, an embodiment is preferred in which only the valve disc or valve tongue of the valve sealing off against the atmosphere has at least one capillary passage as pressure relief connection.

On the basis of the increased internal friction resulting from a longer bore, it may be advantageous if the capillary passage has an inside diameter dependent on the thickness of the elastic valve disc or valve tongue, in the sense of an enlargement in diameter for increasing thickness of the valve disc or valve tongue. For, the thicker the valve disc or the like is, the slower a reflux develops during operation of the reciprocating piston machine according to the invention.

It has proved to be suitable if the capillary passage in the valve disc has an inside diameter of about 0.2 mm to 0.5 mm.

While, due to their high sealing property, valve discs consisting of an elastomer are used in vacuum pumps, preference is given to metallic valve tongues or spring tongues in compressors, where rubber material would otherwise not be so resistant owing to the higher operating temperatures. With these valve tongues, however, the reflux may take place only with an inadequate delay, because the thin metallic valve tongues put up too little resistance to the gas flow. A further development of the invention therefore contemplates that provided in the area between the valve seat and the valve tongue or the like is a capillary-bypass-passage connecting at least one valve port to that opening of the capillary passage provided in the valve tongue or the like which faces the valve seat.

In such an embodiment constituting a further development of the invention, an adequate capillary path is now provided for and/or an adequate resistance is now put up to this gas flow so as to achieve a sufficient delay in the reflux, such not becoming apparent during the operation of the pump, but enabling a pressure compensation after this pump has been stopped. At the same time, the reflux-delaying effects of the capillary passage provided in the valve tongue complement those of the capillary-bypass-passage whose clear sectional area is adapted to the inside diameter of the capillary passage and preferably has about the same inside diameter.

An embodiment of the invention, which is simple and easily producible, envisages that the capillary-bypass-passage takes the form of a longitudinally open groove or hollow, which is arranged in that side of the valve tongue or the like which faces the valve seat and/or is arranged in the valve seat.

For the above-mentioned reasons, it is advantageous for pumps operated with higher operating temperatures if the valve body has a metallic valve tongue. In contradistinction, an embodiment of the invention preferred particularly for vacuum pumps proposes that the valve body has a valve disc consisting of an elastomer.

It is especially advantageous if the capillary passage is disposed approximately midway between a central mount and the outer edge of the valve disc or the like and is associated to at least one valve port of a valve.

A preferred further development of the invention proposes that the valve disc has a central mount, preferably by means of a pin penetrating it, and that the valve seat or the valve disc on the side thereof facing the valve seat has a ring channel at a radial distance corresponding to the radial distance of the capillary passage from the central mount. In this embodiment constituting a further development of the invention, the comparatively small and inconspicuous capillary passage does not have to be brought into register with the valve port associated to it. Rather, by way of a ring channel, the capillary passage in the valve disc is in communication with one valve port or with several valve ports associated to it.

Further features of the invention follow from the description below of exemplary embodiments of the invention, taken in conjunction with the claims and drawings. The individual features can be realized singly or severally in an embodiment of the invention.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
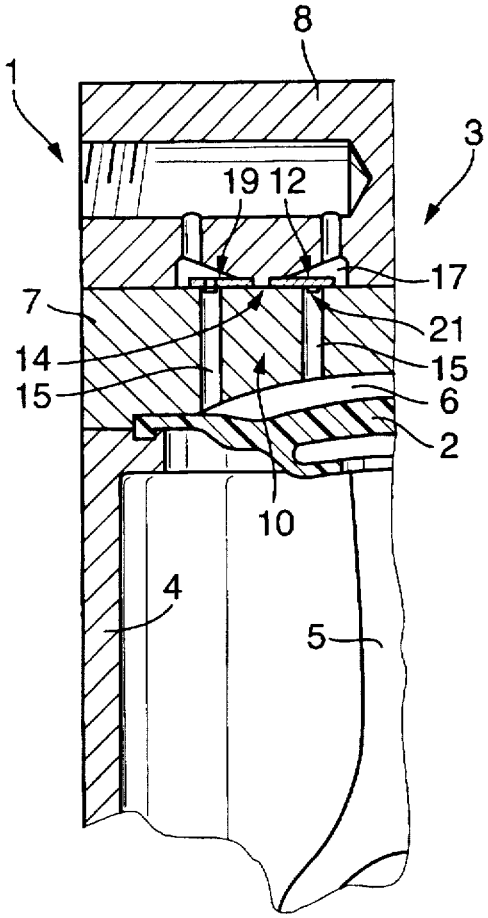
FIG. 1 is a reciprocating piston machine of the invention shown only in part, in a longitudinal section in the region of its outlet valve, whereby the outlet valve has a valve disc exhibiting a capillary passage.
Figure 2:
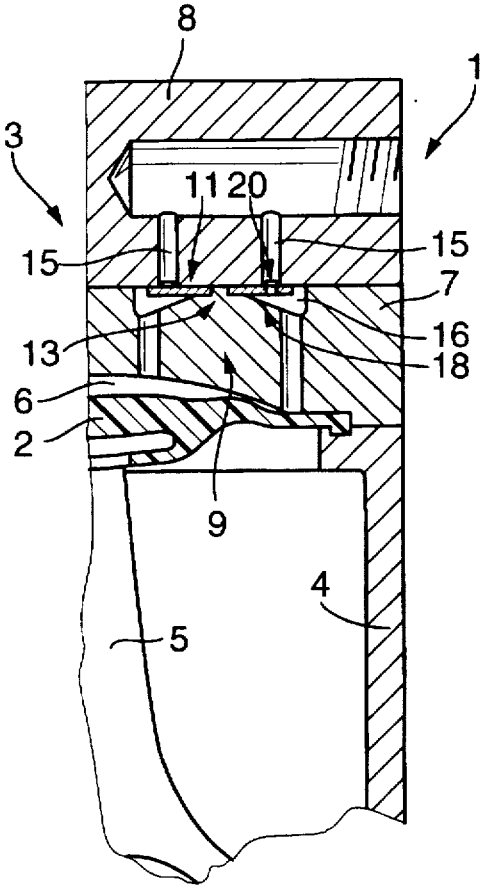
FIG. 2 is a reciprocating piston machine likewise only shown in part, similar to that of FIG. 1, in a longitudinal section in the region of its inlet valve, whereby here the inlet valve has the capillary passage in the valve disc.

FIGS. 1 and 2 each depict a part of a longitudinal section through a reciprocating piston machine, here in the form of reciprocating piston pumps and in particular diaphragm pumps 1. The diaphragm pumps 1 each have a thin elastic shaped diaphragm 2 serving as displacer, peripherally firmly clamped between a pump head 3 and a pump case 4.

The diaphragms 2 of the diaphragm pumps 1 are in each case moved to and fro by means of a connecting rod 5.

The shaped diaphragm 2 on the one hand and the pump head 3 of each diaphragm pump 1 on the other define the compression chamber 6 of these pumps 1. The pump head 3 of the diaphragm pumps 1 is of substantially two-piece configuration and has an intermediate cover 7 and an end cover 8. In the pump head 3 of the diaphragm pumps 1 there is in each case an inlet valve 9 and a outlet valve 10 provided. While FIG. 1 shows the diaphragm pump 1 in the region of its outlet valve 10, the diaphragm pump 1 according to FIG. 2 is shown in the region of the inlet valve 9. The valves 9, 10 each have a valve body in the form of a round valve disc 11, 12 consisting of an elastomer. These valve discs 11, 12 can be e.g. of tongue-shaped or, as in the present instance, round configuration.

Each valve disc 11, 12 is mounted centrally on a pin 13 and 14, respectively, which penetrates it and is integrally formed with the end cover 8 in the case of the outlet valve 10 and with the intermediate cover 7 in the case of the inlet valve 9. Each of the valves 9, 10 has a plurality of valve ports 15 upstream of the valve discs 11, 12 associated to them, as considered in the direction of flow. The valve discs 11, 12 cooperate with a valve seat formed by the pump head 3 in a peripheral area thereof bordering the valve ports 15. In the closed position depicted in FIGS. 1 and 2, the valve discs 11, 12 bear against the valve seat. In their open positions, the valve discs are deflected with their free peripheral area into a recess 16, 17 of the pump head 3 for the valve opening movements.

To be able to remove the pressure or vacuum remaining in the compression chamber 6 when the diaphragm pump 1 is stopped, so that the pumps 1 can be restarted load-free in this respect, the valve discs 11, 12 of the valves 9, 10 have a capillary passage 18,19, here shown exaggerated in size, as pressure relief connection. Capillary passage will be understood to signify a connecting passage with a tight sectional area which, by comparison, is very small.

Whereas in the case of universal reciprocating piston pumps, usable both as a compressor and as a diaphragm pump, at least one such capillary passage 18, 19 should be provided in the inlet valve 9 and in the outlet valve 10 and can be formed as follows from looking at FIGS. 1 and 2 together. Otherwise, this capillary passage 18, 19 is provided in the valve disc 11, 12 of the valve 9, 10 sealing off against the atmosphere, so that the compression chamber 6 can be brought quickly and simply to atmospheric pressure after the pump 1 has been put out of operation. In a vacuum pump 1, according to FIG. 1, the capillary passage 19 is hence provided only in the outlet valve 10, while in the compressor according to FIG. 2 preferably only the inlet valve 9 has such a capillary passage 18. When the valve 9, 10 is closed, this capillary passage 18, 19 leads from the compression chamber 6 to the outer surface of the valve disc 11, 12 facing away from the compression chamber 6. During operation of the reciprocating piston machine 1, this capillary passage 18, 19 has no influence and no function. This is so since a reflux from the atmosphere into the compression chamber 6 (vacuum pump according to FIG. 1) or from the compression chamber 6 into the atmosphere (compressor according to FIG. 2) can develop via the capillary passage at most in the short time in which the to-and-fro moving valve disc 11,12 bears against the valve seat. With the speeds of several 1000 rpm usual for reciprocating piston pumps and particularly for diaphragm pumps, however, the valve disc 11, 12 each time bears only for a fraction of a second against the valve seat. In this short time the reflux is at most minimal because, to form the reflux, the gas first has to develop a certain velocity of flow. During operation, the capillary passage 18, 19 hence has practically no effects on the volumetric efficiency and on the final pressure achievable.

After the reciprocating piston machines according to FIGS. 1 and 2 have been put out of operation, however, the valve 9, 10 concerned is closed, so that sufficient time is available to develop a gas flow through the capillary passage. Therefore, within a short time, a pressure compensation to atmospheric pressure takes place in the compression chamber 6, so that subsequent restart of the pumps 1 can take place load-free in this respect.

It becomes apparent from FIGS. 1 and 2 that the capillary passage 18, 19 is disposed approximately midway between the central mount formed by the pin 13, 14 and the outer edge of the valve disc 11, 12 concerned. Associated to each capillary passage 18, 19 is a plurality of valve ports 15 of one of the valves 9, 10. These valve ports 15 are interconnected by way of a ring channel 20, 21 open toward the adjacent valve disc 11, 12. The ring channel 20, 21 of the valves 9, 10 has a radial distance corresponding to the radial distance of the capillary passage 18, 19 from the central mount formed by the pin 13, 14. Since the capillary passage 18, 19 in the corresponding valve disc 11, 12 is hence connected via the associated ring channel 20, 21 to all the valve ports 15 of the inlet valve 9 or outlet valve 10, especial attention need not be paid that the capillary passage 18, 19 is aligned to one of the valve ports 15 when assembling the pumps 1.

Additionally or alternatively, the ring channel 20, 21 can also be provided on that side of the valve discs 11, 12 which faces the valve seat.

Figure 3:
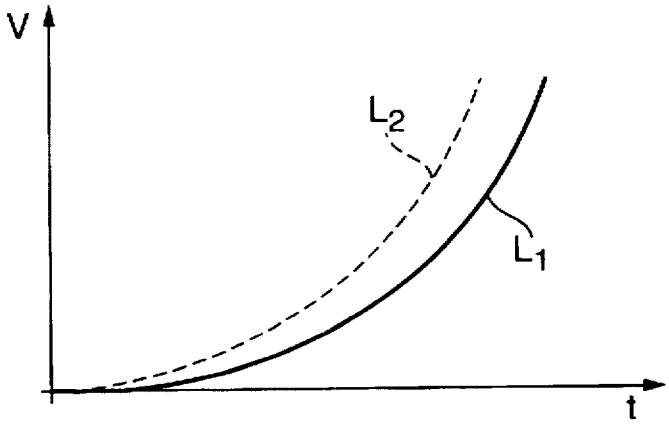
FIG. 3 is a diagram showing the loss volume (V) escaping by way of the capillary passages in FIGS. 1 and 2 as a function of time (t) with valve discs differing in thickness.

FIG. 3 shows that the thicker the valve disc 11, 12 is, the slower the reflux produced through the capillary passages 18, 19 in the closed position of the valves 9, 10 develops, owing to the greater internal friction resulting from a longer bore. While in FIG. 3 a continuous line $L_1$ shows the loss volume V of a thick valve disc 11, 12, the dashed line $L_2$ in FIG. 3 shows the loss volume V of a thinner valve disc plotted against time. The inside diameter of the capillary passage 18, 19 can therefore be selected in dependence on the thickness of the elastic valve disc 11, 12, in the sense of an enlargement in diameter of the capillary passage 18, 19 for increasing thickness of the valve disc 11, 12. In addition, it becomes clear from FIG. 3 that the reflux developed through the capillary passages 18, 19 requires a certain time to develop and that therefore these capillary passages have no influence during operation of the pumps 1.

Such a capillary passage 18, 19 in the valve disc 11, 12 is usable to advantage in various reciprocating piston machines and particularly in piston pumps and diaphragm pumps.

Figure 4:
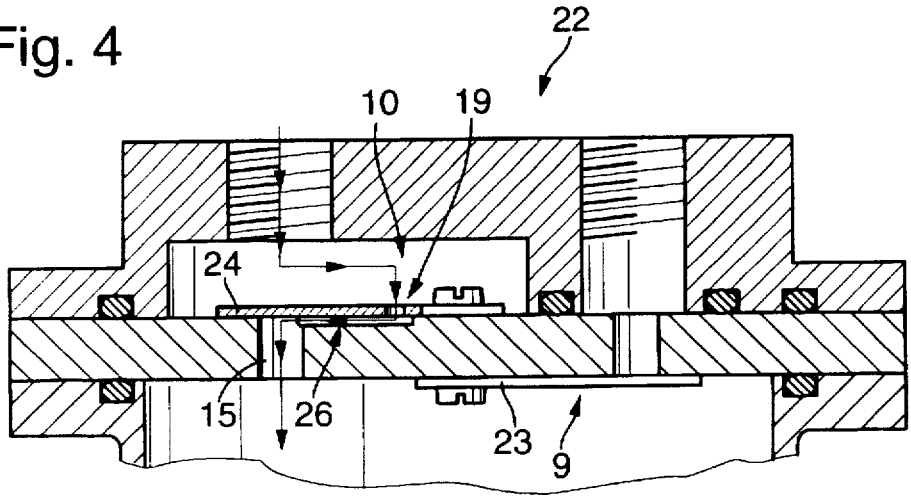
FIG. 4 is a reciprocating piston machine represented in a longitudinal section, similar to that of FIG. 1, whose outlet valve has a valve tongue exhibiting a capillary passage as pressure relief connection.
Figure 5:
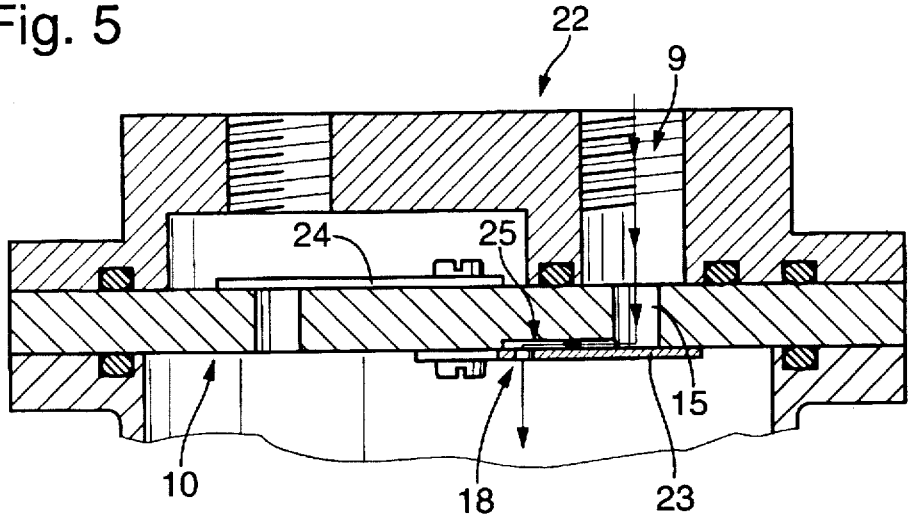
FIG. 5 is a reciprocating piston machine, similar to those of FIGS. 2 and 4, whereby here the inlet valve has a valve tongue with capillary passage.

In FIGS. 4 and 5, two reciprocating piston machines are shown which, similarly as in FIGS. 1 and 2, take the form of reciprocating piston pumps 22 and in particular diaphragm pumps. The reciprocating piston pumps 22 have valves 9, 10 which in each case have a valve body with an elastic valve tongue or spring tongue 23, 24 made of metal. These metallic valve tongues 23, 24 also withstand higher operating temperatures, as occur for instance in compressors.

As becomes manifest in comparing FIGS. 4 and 5, the valve tongue 23, 24 of one of the two valves 9, 10 of the reciprocating piston pumps 22 according to FIGS. 4 and 5 has a capillary passage 18, 19. Whereas this capillary passage 19 is provided at the outlet valve 10 in the reciprocating piston pump 22 depicted in FIG. 4, the capillary passage 18 is arranged at the inlet valve 9 in the reciprocating piston pump 22 of FIG. 5.

Due to the small thickness of the valve tongues 23, 24, however, it is possible that they may be unable to bring about sufficient delay of the reflux. Provided in the area between the valve seat and the valve tongue 23, 24 is therefore a capillary-bypass-passage 25, 26 connecting the valve port 15 of the valve 9, 10 concerned to that opening of the capillary passage 18, 19 which faces the valve seat. This capillary-bypass-passage 25, 26 is here in the form of a groove which is arranged in the valve seat and is longitudinally open toward the valve tongue 23, 24. A capillary-bypass-passage is here understood to be such a bypass passage as has a very small clear sectional area adapted to the capillary passage 18, 19. The capillary passage 18, 19 and the capillary-bypass-passage 25, 26 preferably have about the same clear sectional area.

Figure 6:
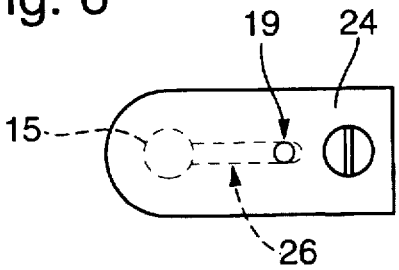
FIG. 6 is a valve tongue of the reciprocating piston pumps according to FIGS. 4 and 5 in a plan view.

In FIG. 6 it is depicted that the capillary passage 19 of the outlet valve 10, here shown only by way of example, is arranged in spaced relationship to the valve port 15. The capillary-bypass-passage 26 hence connects the valve port 15 to the capillary passage 19 provided in the valve tongue 24. The capillary passage 18, 19 and the capillary-bypass-passage 25, 26 hence complement each other in their effect delaying the reflux. As a result, an adequate capillary path is now provided for and/or an adequate resistance is now put up to this reflux so as to achieve the delay wanted of the reflux, such not becoming apparent during the operation of the reciprocating piston pumps 22, but enabling a pressure compensation after these reciprocating piston machines have been stopped. By means of this pressure compensation, the compression chamber of the reciprocating piston machine 22 can be pressure-relieved in a short time after stoppage, without substantially reducing the volumetric efficiency during operation.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A reciprocating piston machine (1, 22) comprising a compression chamber with an inlet valve (9) on a suction side and an outlet valve (10) on a delivery side, said valves (9, 10) include a valve body having an elastic valve disc (11, 12) or valve tongue (23, 24), whereby the compression chamber (6) which is sealed off by a reciprocating piston or similar displacer (2) and by the valves (9, 10) has a pressure relief connection between the compression chamber (6) and atmosphere, the valve disc (11, 12) or valve tongue (23, 24) of the valve (9, 10) on at least one of the delivery side and the suction side has at least one capillary passage (18, 19) as the pressure relief connection.

2. The reciprocating piston machine as claimed in claim 1, wherein the valve disc (11, 12) or valve tongue (23, 24) of the valve (9, 10) sealing off against the atmosphere has at least one capillary passage (18, 19) as the pressure relief connection.

3. The reciprocating piston machine as claimed in claim 1, wherein the capillary passage (18, 19) has an inside diameter dependent on a thickness of the elastic valve disc (11, 12) or valve tongue (23, 24), such that an enlargement in diameter is provided for an increasing thickness of the valve disc (11, 12) or valve tongue.

4. The reciprocating piston machine as claimed in claim 1, wherein the capillary passage (18, 19) in the valve disc (11, 12) or valve tongue (23, 24) has an inside diameter of about 0.2 mm to 0.5 mm.

5. The reciprocating piston machine as claimed in claim 1, wherein provided in an area between the valve seat and the valve tongue (23, 24) is a capillary-by-pass-passage (25, 26) connecting at least one valve port (15) to an opening of the capillary passage (18, 19) provided in the valve tongue (23, 24) which faces the valve seat.

6. The reciprocating piston machine as claimed in claim 5, wherein the capillary-by-pass-passage (25, 26) takes the form of a longitudinally open groove or hollow, which is arranged in a side of the valve tongue (23, 24) which faces the valve seat and/or is arranged in the valve seat.

7. The reciprocating piston machine as claimed in claim 5, wherein the capillary passage (18, 19) and the capillary-by-pass-passage (25, 26) have about the same open cross-sectional area.

8. The reciprocating piston machine as claimed in claim 1, wherein the valve body has a metallic valve tongue or spring tongue (23, 24).

9. The reciprocating piston machine as claimed in claim 1, wherein the valve body has a valve disc (11, 12) comprising an elastomer.

10. The reciprocating piston machine as claimed in claim 1, wherein the capillary passage (18, 19) is disposed approximately midway between a central mount and an outer edge of the valve disc (11, 12) and is associated to at least one valve port (15) of a valve (9, 10).

11. The reciprocating piston machine as claimed in claim 1, wherein the valve disc (11, 12) or valve tongue has a central mount, and that the valve seat or the valve disc (11, 12) on a side thereof facing the valve seat has a ring channel (20, 21) at a radial distance corresponding to the radial distance of the capillary passage (18, 19) from the central mount.

12. The reciprocating pump as claimed in claim 11, wherein the central mount comprises a pin (13, 14) penetrating the valve disc (11, 12) or valve tongue.

13. The reciprocating piston machine as claimed in claim 1, wherein the reciprocating piston machine comprises a reciprocating piston pump.

14. The reciprocating piston machine as claimed in claim 13, wherein the reciprocating piston pump comprises a gas pump.

* * * * *